US006591645B1

(12) United States Patent
Wittwer

(10) Patent No.: US 6,591,645 B1
(45) Date of Patent: Jul. 15, 2003

(54) CLOSING CYLINDER, ESPECIALLY FOR VEHICLES

(75) Inventor: Reinhard Wittwer, Heiligenhaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/806,106

(22) PCT Filed: Sep. 3, 1999

(86) PCT No.: PCT/EP99/06496

§ 371 (c)(1),
(2), (4) Date: Mar. 28, 2001

(87) PCT Pub. No.: WO00/20709

PCT Pub. Date: Apr. 13, 2000

(30) Foreign Application Priority Data

Sep. 29, 1998 (DE) ..... 198 44 593

(51) Int. Cl.[7] ..... E05B 29/00
(52) U.S. Cl. ..... 70/366; 70/377
(58) Field of Search ..... 70/366, 365, 377, 70/422

(56) References Cited

U.S. PATENT DOCUMENTS

| | | | | | |
|---|---|---|---|---|---|
| 3,789,638 | A | | 2/1974 | Roberts et al. | 70/366 |
| 3,928,992 | A | | 12/1975 | Talbot | 70/366 |
| 4,336,700 | A | | 6/1982 | Baltscheffsky et al. | 70/366 |
| 4,351,172 | A | * | 9/1982 | Martikainen | 70/366 |
| 4,370,875 | A | | 2/1983 | Piiroinen | 70/422 |
| 4,418,555 | A | * | 12/1983 | Uyeda | 70/366 |
| 4,624,119 | A | * | 11/1986 | Newman et al. | 70/366 |
| 5,613,389 | A | * | 3/1997 | Hauser | 70/366 |
| 6,003,351 | A | * | 12/1999 | Chao et al. | 70/366 |

* cited by examiner

*Primary Examiner*—Suzanne Dino Barrett
(74) *Attorney, Agent, or Firm*—Friedrich Kueffner

(57) ABSTRACT

The invention relates to a closing cylinder comprised of a cylinder core (10) which is rotationally accommodated in a cylinder housing (20), and which has a profiled axial boring (11). An axially parallel roll body (25) is arranged in said closing cylinder and is always guided with a partial cross-section (26) in a radial opening (14) of the cylinder core. According to whether an initial position of rotation or a key rotation exists, the blocking element (25) either runs into an inner groove (24) of the cylinder housing (20) or into a marginal recess (34) of a group of rotating discs (30) which are arranged in a profiled axial boring (11) of the cylinder core (10). In order to increase the useful life of the closing cylinder, the invention provides that a spring element (50; 28, 50') is arranged at least between one of the rotating discs (30) and the cylinder core (10). The spring load resulting therefrom blocks, via a blocking surface provided on the rotating disc (30), the blocking element (25) in the cylinder housing (20) in a manner which prevents rotation. The cylinder core (10) comprises, with the axial section thereof serving to accommodate the rotating discs (30), a radial recess (12; 12') for the spring element, and the recess (12', 12') is connected via a radial slot (54) to the axial boring (11) of the cylinder core (10) which accommodates the rotating discs (30).

5 Claims, 4 Drawing Sheets

CLOSING CYLINDER, ESPECIALLY FOR VEHICLES

BACKGROUND OF THE INVENTION

1. Field of the Invention

The invention relates to a closing cylinder, in particular, for vehicles, for actuating a lock and/or a switch by means of a key inserted into a key channel:

2. Discussion of the Related Art

In the known closing cylinder of this kind the cylinder core, which is rotatably received in the cylinder housing, has a profiled axial bore and in the axial bore several successively arranged rotary disks are provided which function as tumblers. These rotary disks are loose and have central openings which determine the key channel. The key has radial cuts with defined control shoulders while the profiled central opening has counter shoulders. The rotary disks have a circular profiled disk contour with a radial cutout and with a locking surface delimiting the radial cutout. Moreover, the closing cylinder has an axis-parallel, loose locking member, which is, in particular, embodied as a roll body and is always guided with a partial cross-section within a radial penetration of the hollow cylindrical cylinder core. In an initial rotational position of the cylinder core, in which the insertion and removal of the key is possible, the locking member engages with a remaining cross-section an axial inner groove of the cylinder housing. In this initial rotational position the locking member is radially supported by the peripheral locking surface of the rotating disk so that a rotation of the cylinder core is impossible. When, however, the rotary disk is moved by actuation of the key in the direction of a working rotational position of the cylinder core, the edge cutout of the rotary disk is aligned with the locking member and serves for receiving the remaining cross-section of the locking member while the inner groove of the cylinder housing comes free from the locking member.

The disadvantage of the known closing cylinder of this kind is that in it the cylinder core can be moved, without the proper key, by a so-called "picking method" with burglary tools from the locking-active initial rotational position into a working rotational position of the cylinder core in which the lock which is provided with such a closing cylinder can be opened. In this picking method the individual rotary disks are rotated by a pin until the edge cutouts provided on their disk contour are aligned with the axis-parallel locking member so that a coupling connection between the rotary disks and the cylinder core is realized. Then, a rotation action exerted onto the rotary disks can move the cylinder core and transfer it into its working rotational position.

In a known closing cylinder (DE 39 24 971 A1) each one of the rotary disks is provided with a radial nose which is positioned between the two legs of a return spring. The legs of the return spring penetrate two sector-shaped peripheral cutouts in the individual rotary disks. They serve for providing a return movement of the return spring into an initial rotational position, independent of whether the rotary disks have been turned by the key in the clockwise or counterclockwise direction. The return spring requires because of the peripheral sector cutouts in the rotary disks a considerable amount of space. The anti-burglary safety with respect to the aforementioned picking method cannot be improved by means of the return spring.

SUMMARY OF THE INVENTION

The invention has the object to develop a burglary-proof closing cylinder of the aforementioned kind. This is achieved according to the invention by the features which will be explained in more detail in the following.

In the invention, the spring member has approximately an L-shaped axial profile. With one of its L-legs it is positioned in a radial cutout of the cylinder core which is connected via a radial slot with the axial bore of the cylinder core. The other L-leg of the spring member according to the invention projects through this radial slot radially inwardly and supports itself therein on a shoulder of at least one of the rotary disks. When it is attempted to slide the rotary disks according to the picking method, it is necessary to perform a work against the spring load. As soon as the rotary disk is released by the burglary tool, it rotates back into its locking position. The cutout in the cylinder core can be arranged in the peripheral area of the annular cylinder core. The radially inwardly projecting leg can have a very small leg thickness. This results in an extremely space-saving arrangement for the spring member. The shoulder for supporting the radial leg of the spring member can advantageously be the radial shoulder of the rotary disk which serves for entraining the cylinder core upon key rotation of the rotary disks. For this entrainment the cylinder core is provided with an inner radial counter shoulder.

BRIEF DESCRIPTION OF THE DRAWINGS

Further features and advantages of the invention result from the dependent claims, the following description, and the drawings. In the drawings, two embodiments of the invention are illustrated. It is shown in:

DESCRIPTION OF PREFERRED EMBODIMENTS

Figure 1:
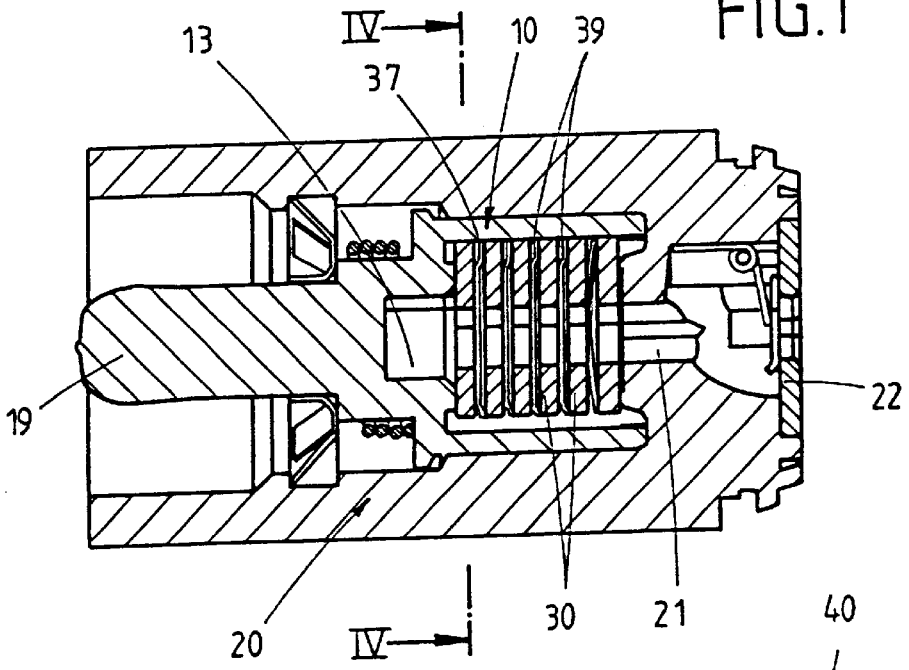
FIG. 1 an axial section through the closing cylinder according to the invention.
Figure 2:
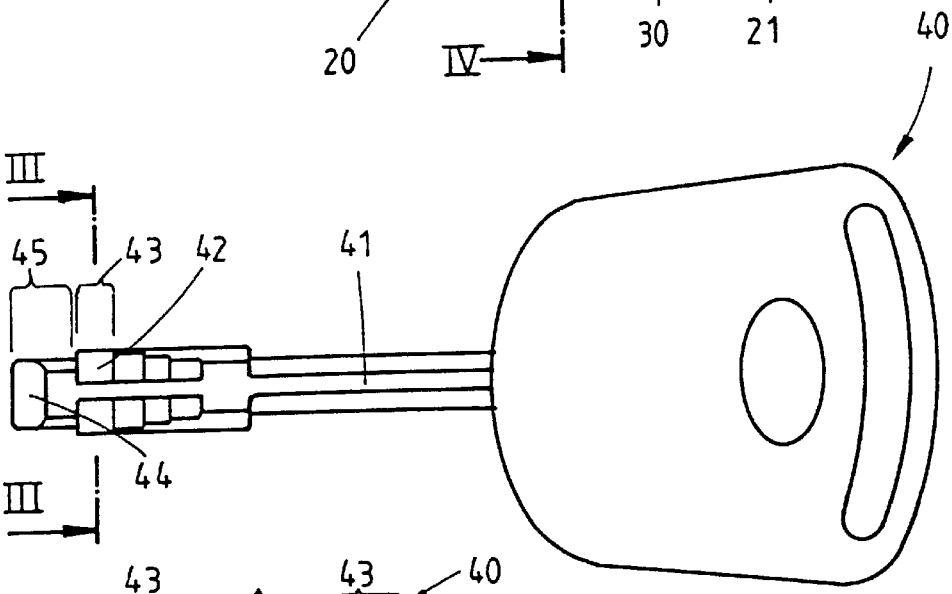
FIG. 2 a side view of a key correlated with the closing cylinder.

The closing cylinder comprises a cylinder core 10 which is rotatably received in a cylinder housing 20 and has a profiled axial bore 11. This portion of the cylinder core 10 is ring shaped. In the cylinder housing 20 a loose locking member 25 is provided which is comprised of a roll body 25 extending axis-parallel. In the axial bore 11 of the cylinder core a set of axially successively arranged rotary disks 30 is positioned. Between neighboring rotary disks 30 an intermediate disc 39 is arranged which provides, as much as possible, a disturbance-free independent rotation of the individual rotary disk 30. The rotary disks 30 have a profiled central opening 31 which has a defined counter shoulder 32 for control shoulders 42 of a key 40.

Figure 3:
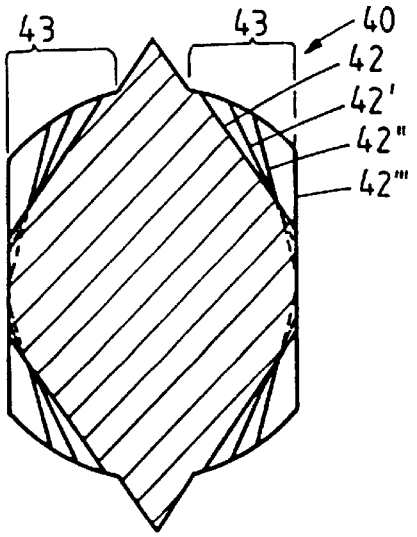
FIG. 3 a cross-section, on a greatly enlarged scale, of the key channel along the section line indicated by III—III in FIG. 2.

The key 40 has in its key shaft 41 several cuts 43 which, as can be seen in FIG. 3, can be profiled differently relative to one another and have defined control shoulders 42 to 42'''. The key 40 can be inserted only in a certain initial rotational position into a key channel 21 of the cylinder housing 20 which is then continued by the central openings 31 of the different disks 30. The free end of the key shaft 41 has a tapered portion 44 which, upon insertion of the key 40, opens the way for the key through the central openings 31 of the rotary disks. The end portion 45 of the key shaft 41 is not round. It is correlated with a plug-in receptacle 13 in the cylinder core 10. When the key end portion 45 is inserted, a rotational engagement with the cylinder core 10 is provided. The key channel 21 is closed by a spring-loaded flap 22.

Figure 4:
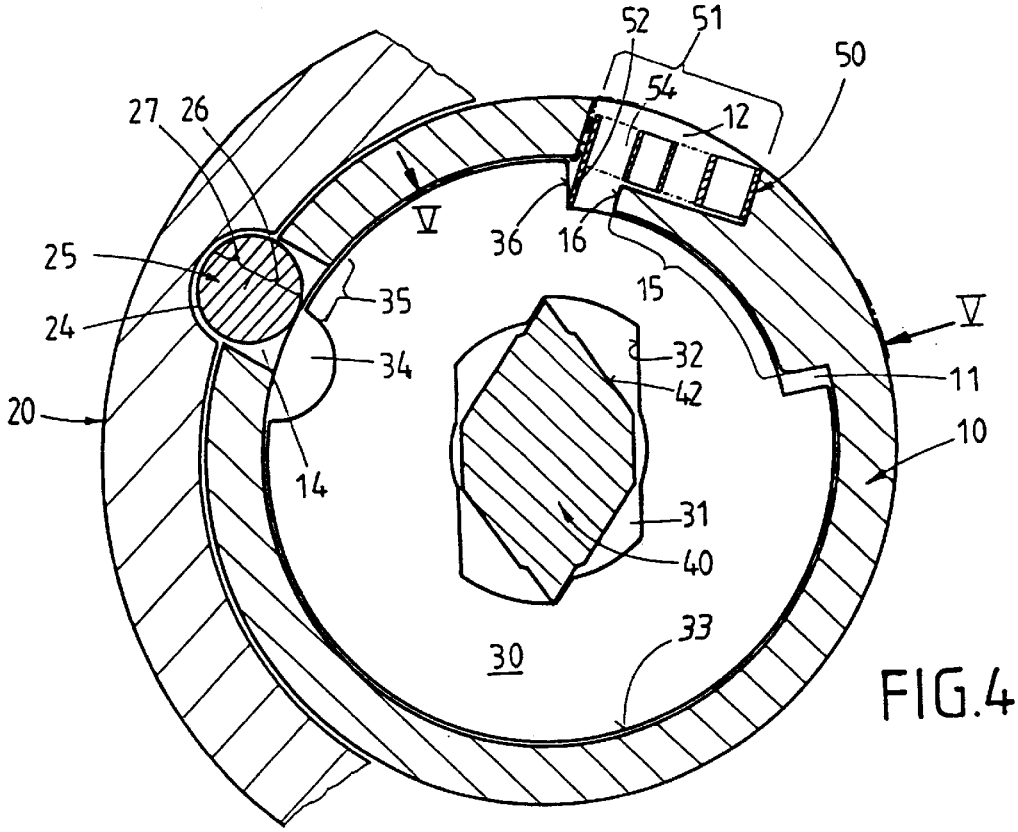
FIG. 4 a cross-section, on an enlarged scale, of the closing cylinder of FIG. 1 along the section line IV—IV indicated therein when the cylinder core is positioned in its initial rotational position and the key, even though it is inserted, has not yet been rotated.

In all rotational positions, the locking member 25 with its partial cross-section 26, shown in FIG. 4, is positioned in a radial cutout 14 of the cylinder core, while the remaining cross-section of the locking member 25 engages an axial inner groove 24 of the cylinder housing 20 when the rotary disk 30 is positioned in the initial rotational position illustrated in FIG. 4. The cylinder core 10 is thus secured against rotation within the cylinder housing 20. In FIG. 4, the control shoulder 42 of the key 40 seated in the central opening 31 is still positioned at a spacing from the correlated counter shoulder 32 of the rotary disk 30.

Figure 5:
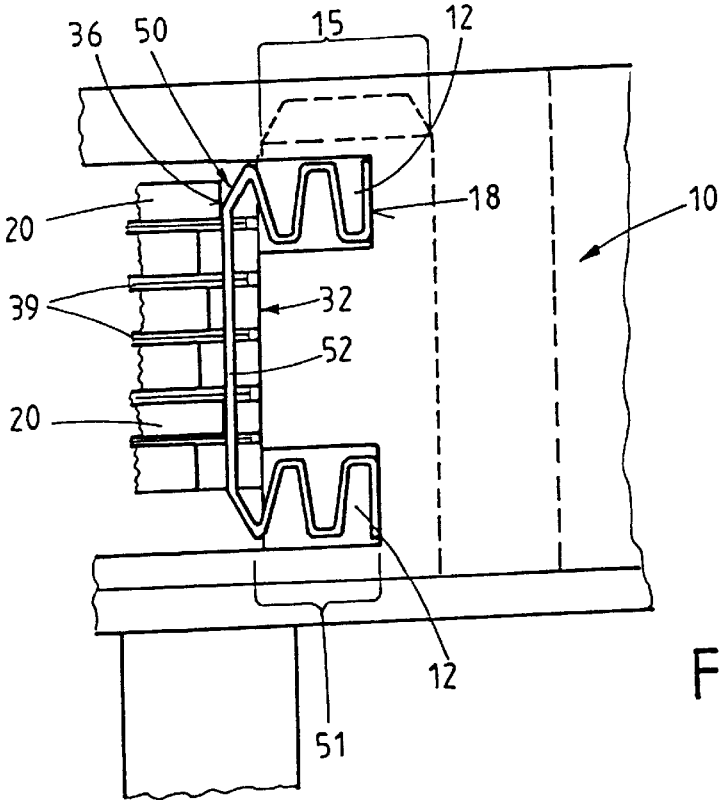
FIG. 5 in partial section a developed view of a portion of the closing cylinder shown in FIG. 1 wherein the section line extends along the offset section line V—V of FIG. 4.

The rotary disk 30 has a circular disk contour 33, but this contour is also profiled. There is firstly the edge cutout 34 which is limited peripherally by the adjoining locking surface 35. When the initial rotational position is present, this locking surface 35 supports the locking member 25 on its mantle surface. This holds true likewise for all further rotary disks 30 which have an analog but different profile of their disk contour 33 in comparison to FIG. 4. The rotary disk 30 has a sector-shaped cutout having a flank which generates the radial shoulder 36. This radial shoulder 36 has correlated therewith a counter shoulder 16 within the axial bore of the cylinder core. The counter shoulder 16 is provided by one flank of a ring segment 15 positioned in the axial bore 11. The cylinder core 10, over portions thereof, is stepped about its periphery and has radially lowered cutouts 12 on its periphery, of which in this embodiment, as shown in FIG. 5, two are arranged at an axial spacing relative to one another. These cutouts 12 are provided for receiving a zigzag-shaped leg 51 of a U-shaped spring member 50, respectively. The spring member 50 has a widened U-stay 52 which is supported in the area of the radial shoulder 36 of the corresponding disk 30. The U-stay 52 produces an inwardly projecting leg which projects from the radial slot 54 between the cutout 12 and the axial bore 11. The zigzag shaped legs 51 are springy in the direction of the leg extension and produce a rotationally acting spring elasticity between the cylinder core 10 and the rotary disk 30. In the initial rotational position of FIG. 4, the spring member 50 is substantially unstressed; the radial shoulder 36 on the rotary disk 30 is also not loaded, and the end surface 18 of the cutout 12 is not loaded either. This changes only when by means of a burglary tool, not represented, or by the key 40 a torque is exerted onto the rotary disk 30 according to FIG. 6.

Figure 6:
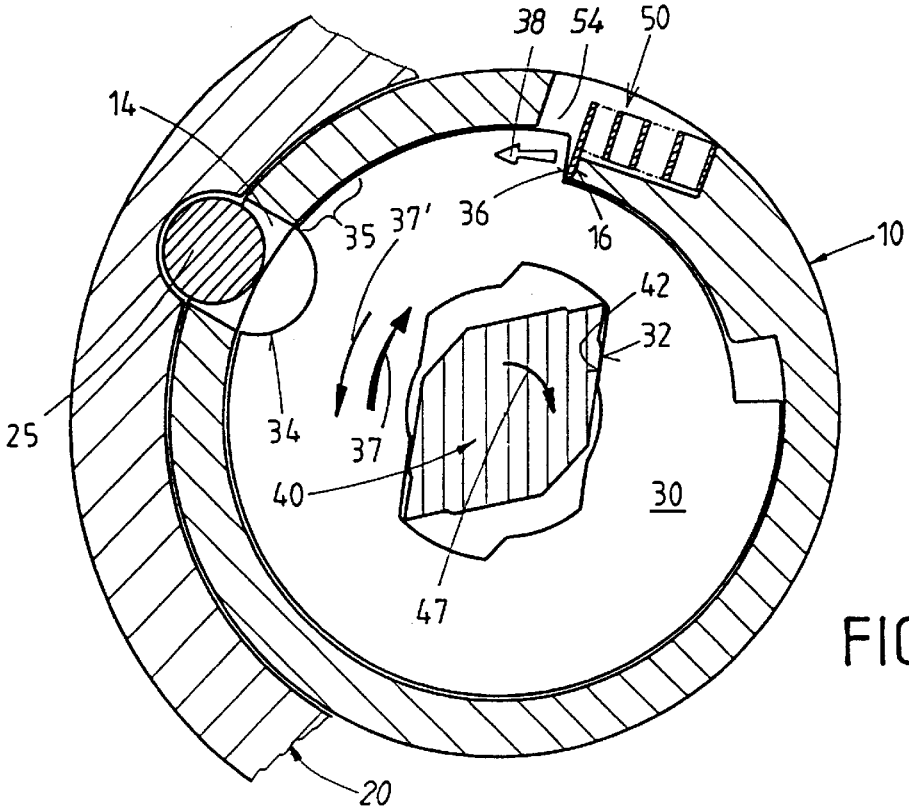
FIG. 6 in a representation corresponding to FIG. 4 a cross-section of the closing cylinder wherein the inserted key has rotated the components from their initial rotational position of FIG. 4 in the direction of a working rotational position.

During the key rotation 47, the control shoulder 42 on the key, correlated with the rotary disk 30, impacts the counter shoulder 32 on the disk so that the disk rotation 37 illustrated in FIG. 6 takes place. In FIG. 6 the initial phase of the disk rotation 37 is illustrated, where the radial shoulder 36 of the disk 30 impacts on the counter shoulder 16 of the cylinder core 10. Accordingly, the spring member 50 has been compressed maximally and exerts a return force which is illustrated by arrow 38 in FIG. 6. In FIG. 6 it is presupposed that the locking member 25 still produces the rotational blocking action of the cylinder core 10 relative to the cylinder housing 20 even though the edge cutout 34 of the disk 30 is already more or less in radial alignment with the radial cutout 14 in the cylinder core 10. This may be so because at least one of the further rotary disks 30 with their circumferential locking surface 35 are still in their support position on the locking member 25. If instead of the key 40 manipulations by a burglary tool have caused the disk rotation 37 and have interrupted the pressure on the counter shoulder 32 for a short period of time, as a result of the return force 38 the disk 30 rotates back by itself in the direction of arrow 37'. The position illustrated in FIG. 4 is again reached. Accordingly, the anti-burglary safety of the closing cylinder according to the invention is improved.

Figure 7:
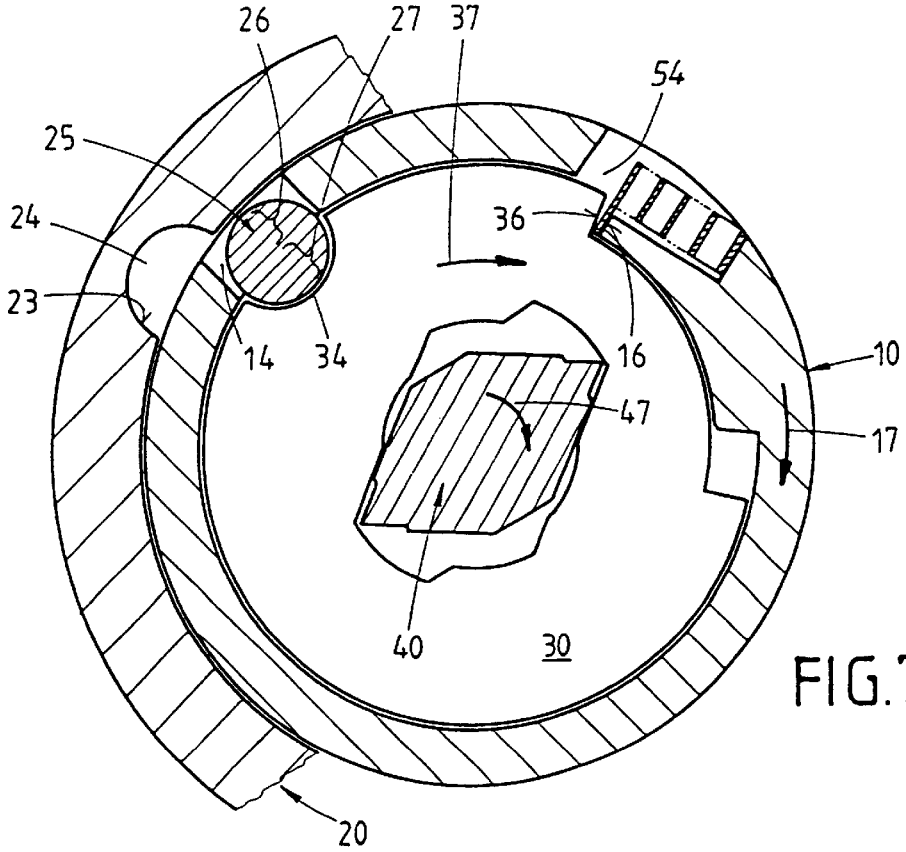
FIG. 7 a rotational position of the components following the rotation of the key of FIG. 6.

When, as illustrated in FIG. 7, the disk 30 is further rotated by the key 40, by means of the surface contact of the two cooperating radial shoulders 36, 16 the cylinder core 10 is finally also rotated in the direction of arrow 17 of FIG. 7. In doing so, the locking member 25 is pressed out by means of control surfaces 23 provided on the inner groove 24 of the cylinder housing 20 and engages the edge cutout 34. In this case, a partial cross-section 26 of the locking member 25 is still positioned in the radial cutout 40 of the cylinder core 10, but now the locking member 25 engages with its residual cross-section 27 the edge cutout 34. Accordingly, a coupling between the cylinder core 10 and the rotary disk 30 results. This effects also the rotation 17 of the cylinder core illustrated in FIG. 7. According to FIG. 1, such a cylinder core rotation is transmitted by means of output members 19, fixedly connected to the cylinder core 10, to adjacent functional members of the lock or the switch. The cylinder core thus reaches finally one or more working rotational positions which fulfill corresponding functions within the lock or the switch.

Figure 8:
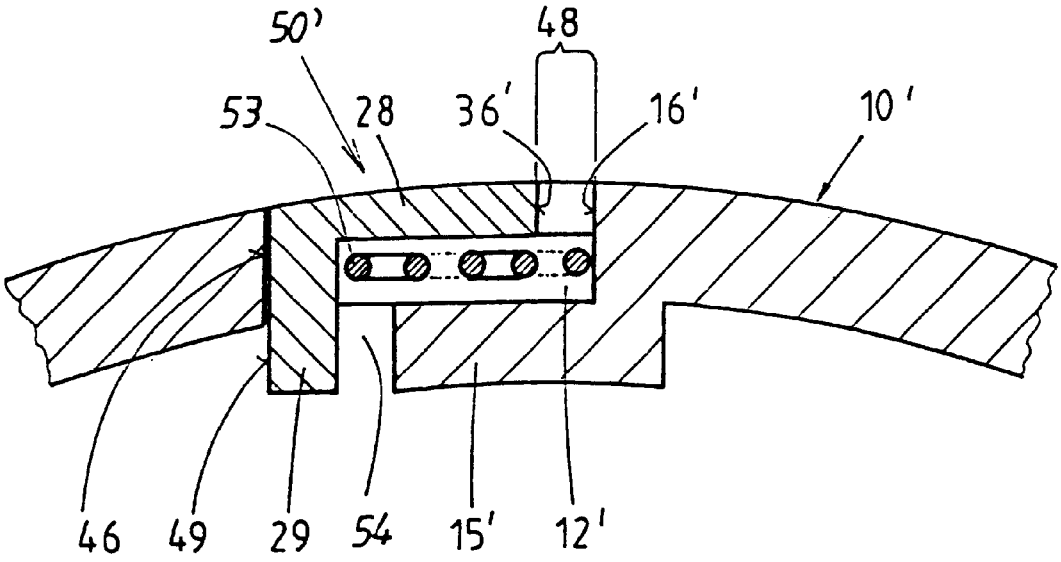
FIG. 8 an alternative embodiment of the closing cylinder illustrated in FIGS. 1 through 7 by means of a portion of a modified cylinder core.

In FIG. 8 an alternative embodiment of the cylinder core 101 with a two-part spring member 50' is shown. A first part of the spring member 50' is a slide 28 and the second part is a pressure spring 53. Since the other components of this alternative closing cylinder are embodied in analogy to the first embodiment according to FIGS. 1 through 7, they have been omitted in FIG. 8. Accordingly, the above description applies. It is sufficient to only point out the differences.

The pressure spring 53 of the spring member 50' in FIG. 8 is shown as a flat zigzag shape which is received in a cutout 12' of the cylinder core 10' extending over the entire length of the zigzag shape. The slide 28 is L-shaped. The cutout 12' is covered by one of the L-legs of the slide 28 while the other radially extending L-leg 29 projects from the slot 54 of the cylinder core 10 into the axial bore 11. This radial leg 29 has a radial flank 49 which, in the already described way, cooperates with a radial shoulder 36 of the rotary disk 30, not illustrated in detail here. A comparison between FIGS. 4 and 8 shows that the pressure spring 53 is not supported directly but indirectly via the radial leg 29 of the slide 28 on the rotary disk 30. The gap present in the initial position according to FIG. 4 between the two cooperating shoulders 36, 16, is provided at a different location, as is illustrated by the analog shoulders 16', 36', i.e., the radial shoulder 36' is positioned now on the peripheral L-leg of the slide 28 and the counter shoulder 16' on an inner shoulder of the cutout 12' and no longer on the flank of the ring segment 15' also provided in this embodiment. The ring segment 15' in this case is of no importance for the disk rotation 37 described in connection with FIGS. 6 and 7.

In the initial rotational position of FIG. 8 these two shoulders 16', 36' are positioned first at a spacing 48 which corresponds to the conditions of FIG. 4. Upon rotational actuation by means of a key 40 or by means of a burglary tool, the spacing 48 of FIG. 8 can be reduced, as described in connection with FIGS. 6 and 7 for the previous embodiment. In this case also, a return force is however effective between the cylinder core 10' and the rotary disk 30 of FIG. 8, not illustrated in detail. This is realized by means of the tensioned pressure spring 53 and the slide 28 via the described radial surface 49 of the radial leg 29.

LIST OF REFERENCE NUMERALS

| | |
|---|---|
| 10 | cylinder core (FIGS. 1 through 7) |
| 10' | alternative cylinder core (FIG. 8) |
| 11 | axial bore of 10 |
| 12 | cutout in 10 |
| 12' | cutout in 10' |
| 13 | plug-in receptacle in 10 for 45 |
| 14 | radial cutout in 10 |
| 15 | ring segment in 11 |
| 15' | ring segment at 10' (FIG. 8) |
| 16 | radial counter shoulder in 11 |
| 16' | radial counter shoulder of 10' at 12' (FIG. 8) |
| 17 | cylinder core rotation |
| 18 | end surface of 12 |
| 19 | output member of 10 |
| 20 | cylinder housing |
| 21 | key channel |
| 22 | springy flap on 20 |
| 23 | control surface for 25 in 24 |
| 24 | axial inner groove of 20 |
| 25 | locking member, roll body |
| 26 | partial cross-section of 25 |
| 27 | remaining cross-section of 25 |
| 28 | slide of 50' (FIG. 8) |
| 29 | radial leg of 28 |
| 30 | rotary disk |
| 31 | central opening in 30 |
| 32 | counter shoulder in 31 |
| 33 | disk contour of 30 |
| 34 | edge cutout in 33 |
| 35 | locking surface of 33 |
| 36 | radial shoulder of 30 |
| 36' | end of peripheral leg of 28 (FIG. 8) |
| 37 | disk rotation of 30 (FIG. 6) |
| 37' | return rotation of disk (FIG. 6) |
| 38 | return force of 50 on 30 |
| 39 | intermediate disk between 30 |
| 40 | key |
| 40 | key shaft |
| 42 | control shoulder |
| 42' | alternative control shoulder at 43 (FIG. 3) |
| 42" | alternative control shoulder at 43 (FIG. 3) |
| 42"' | alternative control shoulder at 43 (FIG. 3) |
| 43 | cutout in 41 |
| 44 | tapered end of 41 |
| 45 | end portion of 41 (FIG. 2) |
| 46 | shoulder on 10' (FIG. 8) |
| 47 | key rotation of 40 (FIG. 6) |
| 48 | spacing between 16', 36' (FIG. 8) |
| 49 | radial flank of 29 |
| 50 | U-shaped spring member (FIG. 5) |
| 50' | alternative spring member of 82, 53 (FIG. 8) |
| 51 | zigzag-shaped leg of 50 |
| 52 | U-shaped stay of 50 |
| 53 | pressure spring of 50' |
| 54 | radial slot |

What is claimed is:

1. A closing cylinder, in particular, for vehicles, for actuating a lock and/or a switch by means of a key (40) inserted into a key channel (21), with a cylinder core (10) which is received rotatably in a cylinder housing (20) and has a profiled axial bore (11), with a locking member (25) having an axis that is to an axis of the cylinder core (10) and loose and embodied, in particular, as a roll body, which locking member (25) is guided with a partial cross-section (26) always within a radial cutout (14) of the cylinder core (10) and which, at least in an initial rotational position of the cylinder core (10) allowing the insertion or removal of the key (40), engages with a remaining cross-section (27) an axial inner groove (24) of the cylinder housing (20), with several, axially successively arranged rotary disks (30) functioning as tumblers and positioned in the axial bore (11) of the cylinder core (10), which rotary disks (30) have a circular profiled disk contour (33) with a radial edge cutout (34) and with a locking surface (35) delimiting the edge cutout (34), wherein the locking surface (35) in the initial rotational position of the rotary disk (30) radially supports the locking member (25), wherein the edge cutout (34) serves for receiving the remaining cross-section (27) of the locking member (25), when the rotary disk (30) is moved away from the initial rotational position by a rotational movement (37) of the key (40) or of a burglary tool, with a spring member (50; 28, 50') which is arranged at least between one of the rotary disks (30) and the cylinder core (10) and exerts a torque onto the rotary disk (30) in order to place the peripheral locking surface (35) of the rotary disk (30) before the radial cutout (14) in the cylinder core (10), where the cylinder core (10) is locked against rotation by means of the locking member (25) within the cylinder housing (20), wherein the cylinder core (10) has an axial portion serving for receiving the rotary disks (30) and is provided with a radial cutout (12; '12') for the spring member (50; 28, 50') and the cutout (12, 12') is connected by a radial slot (54) of the cylinder core (10) with an axial bore (11) of the cylinder core (10) receiving the rotary disks (30), wherein the spring member (50; 28, 50') has a radially inwardly projecting leg (29; 52) which projects from the slot (54) and is supported on a radial shoulder (36) of at least one of the rotary disks (30), wherein the profiled disk contour (33) of the rotary disk (30) has a radial shoulder (36) for rotational engagement of a radial counter shoulder (16) in the profiled axial bore (11) of the cylinder core (10), wherein the spring member (50; 28, 50') is arranged in the transition area between the radial shoulder (36) of the rotary disk (30) and the radial counter shoulder (16) of the cylinder core (10), and wherein the radial leg (29; 52) of the spring member (50; 28, 50') is also supported on the radial shoulder (36).

2. The closing cylinder according to claim 1, wherein the cutout (12; 12') for the spring member (50; 50') in the cylinder core (10) is radially and/or axially stepped.

3. The closing cylinder according to 1, wherein the spring member (50) is comprised of a U-shaped spring which has zigzag-shaped legs (51) which are springy in a direction of the extension of the legs, wherein a bottom stay of the U-shaped spring forms the radially inwardly projecting leg (52').

4. The closing cylinder according to claim 1, wherein the spring element (50') has a spring-loaded (53) L-shaped slide (28) whose one L-shaped leg (29) projects radially inwardly through the slot of the cutout (12') while the other L-leg as a result of the spring-load (53) closes the radial slot (54) of the cutout (12') at least partially.

5. The closing cylinder according to claim 4, wherein the one L-leg (29) of the slide (28) as a result of the spring load (53) is movable in the radial slot (54) in the direction of the peripheral tangent of the cylinder core (10') and comes to rest at a radial shoulder (46) of the cylinder core (11'), and wherein this radial shoulder (46) delimits the radial slot (54) of the cutout (12') on one side.

* * * * *